US005314373A

United States Patent [19]

Caveza et al.

[11] Patent Number: 5,314,373

[45] Date of Patent: May 24, 1994

[54] TOY FOOD PROCESSOR AND SIMULATED OVEN

[75] Inventors: Martin J. Caveza, Redondo Beach; Caleb S. Chung, Van Nuys, both of Calif.; Gregory M. Cannone, Toms River, N.J.

[73] Assignee: Mattel, Inc., El Segundo, Calif.

[21] Appl. No.: 12,088

[22] Filed: Feb. 1, 1993

[51] Int. Cl.[5] ..... A63H 33/30

[52] U.S. Cl. ..... 446/481; 446/475; 446/479

[58] Field of Search ..... 446/479, 481, 482, 246, 446/475

[56] References Cited

U.S. PATENT DOCUMENTS

| | | | |
|---|---|---|---|
| D. 226,960 | 5/1973 | Pasquale | D7/672 |
| D. 255,412 | 6/1980 | Bereza | D7/674 |
| D. 260,274 | 8/1981 | Appel et al. | D21/122 |
| D. 268,318 | 3/1983 | Lutzker | D7/672 X |
| D. 282,942 | 3/1986 | Hartelius | D21/122 |
| 3,808,730 | 5/1974 | Cooper et al. | 446/481 |
| 4,772,243 | 9/1988 | Zeiss | 446/481 |
| 4,857,031 | 8/1989 | Lucas | 446/481 |

*Primary Examiner*—Mickey Yu
*Attorney, Agent, or Firm*—Roy A. Ekstrand

[57] ABSTRACT

A toy food processor and oven includes a generally rectangular housing supporting a slidable tray above an internal simulated baking chamber. The housing includes a frontal opening which receives the tray in a sliding insertion. A food grinder including a pair of parallel rollers and handle crank mechanism is supported by a generally cylindrical housing above the food tray. The food grinder receives a brittle food material such as crackers or the like which is converted or crushed to a particulate material as the rollers are rotated and the food article is inserted between the rollers. The crushed particulate food material is accumulated upon the tray. The tray and food grinder are separated and the particulate food material is formed into a plurality of shaped food articles or patties upon the tray surface. The tray is then inserted into the baking chamber through the frontal opening. A sprinkler assembly is supported within the baking chamber and receives a darkened powdered or finely ground food material such as cinnamon, cocoa or ground chocolate powder which is sprinkled upon the shaped food patties. The accumulated powdered material upon the food patties imparts the appearance of oven browning to the food articles which are then withdrawn from the simulated baking chamber.

17 Claims, 3 Drawing Sheets

TOY FOOD PROCESSOR AND SIMULATED OVEN

FIELD OF THE INVENTION

This invention relates generally to toy food processors and particularly to simulated toy ovens used therein.

BACKGROUND OF THE INVENTION

Toy food products and toy food preparation products have become extremely popular with younger children due to children's inherent enjoyment of mimicking adult activities which surround them. Children seem to enjoy preparing various types of simple foods and find particular enjoyment in those foods which are cooked or baked. A substantial number of safety concerns arise in connection with children's use of devices which heat or cook food and food products. The most obvious of which is the concern that children are able to utilize such products in a manner in which the risk of burn injury to the child user is created.

Faced with the continuing popularity of food preparation-type toys, practitioners in the art have endeavored to provide a variety of such toy products such as toy ovens or the like.

For example, U.S. Pat. No. 4,772,243 issued to Zeiss sets forth a CHILDREN'S TOY OVEN WITH ACCESS TOY SAFETY LATCH in which a child's toy oven comprises a housing having a baking chamber defined therein. An access opening is provided in the wall of the housing for communicating with the baking chamber. A slidable access door provides opening and closing of the access opening. A multiply articulated latch system is operative to preclude the insertion of unwanted foreign objects into the baking chamber.

U.S. Pat. No. 3,808,730 issued to Cooper, et al. sets forth a TOY OVEN having an oven housing and a telescopic food mold supported therein. A compressible food product is received within the oven and is reconfigured by the telescopic mold during a simulated baking process to impart a baked outer appearance to the food product during a simulation of baking.

U.S. Pat. No. 282,942 issued to Hartelius sets forth a TOY OVEN having a generally rectangular housing defining an upper cook top surface and an interior cavity. An elongated rectangular slot is formed in the oven housing and a front knob is operative upon the oven door.

U.S. Pat. No. 260,274 issued to Appel, et al. sets forth a TOY OVEN having a generally rectangular housing defining a horizontal cook top having simulated burners supported thereon. The cook top further includes a vertical rear portion having a window aperture defined therein within which a rotatable drum is located. The toy oven further defines a rectangular housing within which an interior cavity simulating an oven is defined.

U.S. Pat. No. 255,412 issued to Bereza sets forth a PIE CRUST MAKER OR SIMILAR ARTICLE having a horizontal base supporting an upwardly extending frustro-conical mold member. A vertically extending support member is positioned on either side of the base and supports a vertically movable frustro-conical mold member corresponding to the base supported member. A multiple linkage arrangement couples a pivotal arm to the movable mold member to provide compression therebetween and form a frustro-conical pie crust shell between the mold members.

U.S. Pat. No. 226,960 issued to Pasquale sets forth a FOOD MOLD having a pressing member formed of a cylindrical handle having a circular press die at one end thereof and a rectangular press die at the opposite end thereof. A pair of thin walled mold members compatible with the circular and square die members are used in combination therewith.

U.S. Pat. No. 268,318 issued to Lutzker sets forth a CANAPE MAKER OR THE LIKE in which an elongated hollow housing supports a movable plunger therein and defines an exterior shape corresponding to a to-be-formed canape type food item.

While the foregoing described prior art devices have enjoyed some measure of success, there remains nonetheless a continuing need in the art for evermore improved interesting and safe toy ovens and toy food processing products.

SUMMARY OF THE INVENTION

Accordingly, it is a general object of the present invention to provide an improved toy food processor and simulated oven. It is a more particular object of the present invention to provide an improved toy food processor and simulated oven which avoids exposure of young children to potentially harmful or injurious heating elements or the like.

In accordance with the present invention, there is provided a toy oven for use in combination with a crushable food article, said toy oven comprises: a housing defining a baking chamber; crushing means for crushing the food article to form a crushed particulate food material suitable for forming into one or more shaped food objects; and simulated baking means for imparting a baked appearance to the food objects within the baking chamber by depositing a colored powdered material thereupon.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
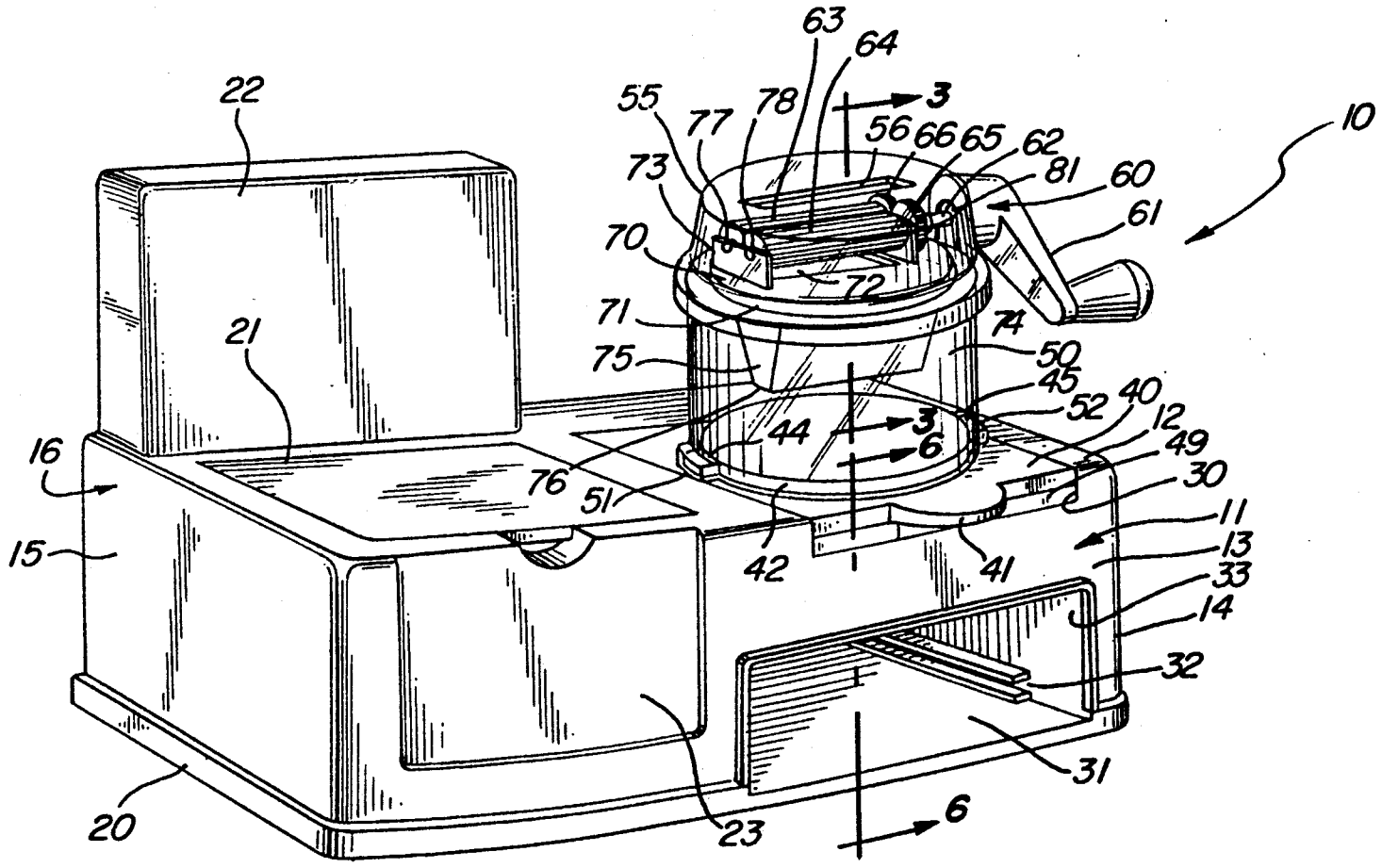
FIG. 1 sets forth a front perspective view of toy food processor and simulated oven constructed in accordance with the present invention.

FIG. 1 sets forth a front perspective view of a toy food processor and simulated oven constructed in accordance with the present invention and generally referenced by numeral 10. Toy food processor and oven 10 includes a generally rectangular housing 11 having a front surface 13, a top surface 12 and opposed side surfaces 14 and 15. Housing 11 further defines a rear surface 16 (better seen in FIG. 6). A generally rectangular base 20 receives and supports housing 11 and provides a support base for toy food processor and oven 10. Housing 11 further defines an elongated rectangular recess 30 formed within top surface 12 and an opening 33 formed in front surface 13. A baking chamber 31 is formed within housing 11 and supports a track 32 upon the interior surface of side 14. While not seen in FIG. 1, a second track similar to track 32 is supported within baking chamber 31 at the opposite side of opening 33.

Recess 30 receives and supports a pivotally secured door 49 upon which a generally planar tray 40 is slidably received. Tray 40 defines an upwardly extending cylindrical raised portion 42 having a pair of lock tabs 44 and 45 extending outwardly from opposite sides thereof. Tray 40 further defines a semi-circular handle 41 extending forwardly beyond recess 30.

A cylindrical wall portion 50 is received upon raised portion 42 and defines a pair of lock members 51 and 52 which cooperatively engage tabs 44 and 45 of raised portion 42 to securely attach cylindrical wall portion 50 to tray 40. In its preferred form, cylindrical wall 50 is fabricated of a clear transparent material such as molded plastic or the like. As is better seen in FIG. 2, cylindrical wall 50 forms an upper lip 53 and a center aperture 54 therein.

A food grinder generally referenced by numeral 60 is received upon and supported by cylindrical wall portion 50 and is covered by a cover 55. More specifically, food grinder assembly 60 includes a grinder housing 70 defining a generally circular plate 71 supporting a downwardly extending trapezoidal food hopper 75. Plate 71 defines a rectangular aperture 72 while food hopper 75 (better seen in FIG. 3) defines a hollow tapered interior terminating in a rectangular downwardly facing aperture 76. Grinder housing 70 further includes a pair of upwardly extending support members 73 and 74. As is better seen in FIG. 2, support member 73 defines a pair of notches 77 and 78 while support member 74 defines corresponding notches 79 and 80. A pair of rollers 63 and 64 are rotatably supported within notches 77, 78, 79 and 80 above aperture 72 of plate 71. Roller 63 supports a gear 66 while roller 64 supports a gear 65. A drive gear 67 is operatively coupled to gears 65 and 66 and is supported by a shaft 62. The latter extends outwardly through slot 81 formed in cover 55 and is secured to a rotatable crank handle 61.

Cover 55 is received upon and supported by cylindrical wall portion 50 in the manner set forth below in FIG. 3. Cover 55 further defines an elongated slot 56 generally aligned with rollers 63 and 64 and generally centered above the interface therebetween.

Housing 11 further defines a raised backing portion 22, a top portion 21 and a front door 23. In its preferred form, door 23 and top 21 are pivotally secured to housing 11 to provide access to the interior portion thereof for functions such as component storage or the like.

In operation, a food material such as crackers or graham crackers or other easily crumbled food material is inserted through slot 56 of cover 55 to be received between rollers 63 and 64. Concurrently, crank handle 61 is rotated to produce a corresponding rotation of rollers 63 and 64 due to the gear coupling between drive gear 67 and gears 65 and 66 of rollers 64 and 63 respectively. The rotating action of rollers 63 and 64 draws the food material downwardly between the rollers in the manner shown in FIG. 3 producing a crumbled particulate material which is received within food hopper 75 and which flows downwardly to be received upon raised portion 42 of tray 40. The granular or crumbled material thus processed is received and contained within cylindrical wall 50 upon raised portion 42. Once the desired quantity of granulated or crumbled food material has been deposited upon raised portion 42, the grinding action is terminated and cylindrical wall portion 50, cover 55 and food grinder assembly 60 are removed as a single unit or separately from tray 40. In its preferred form, cylindrical wall member 50 is removed from tray 40 by rotating cylindrical wall 50 to pivot lock members 51 and 52 away from tabs 44 and 45. In accordance with the operation set forth below in greater detail, the particulate or granulated food matter upon raised portion 42 of tray 40 is then compacted and formed into the desired shapes in the manner shown in FIGS. 4 and 5 placed within baking chamber 31 by sliding tray 40 through opening 33. In accordance with an important aspect of the present invention shown and described below in FIG. 6, the baking process is simulated within baking chamber 31 by sprinkling a darkened food material such as ground cinnamon, ground chocolate powder, or cocoa powder upon the food items within baking chamber 31 to produce an "oven browned" appearance to the food articles. Thereafter, the food articles are removed from baking chamber 31 by sliding tray 40 outwardly and may be collected or eaten as the user desires.

Thus, in accordance with an important aspect of the present invention, the simulation of the baking process using an oven baking chamber which imparts a baked appearance to the food articles without the use of heat or actual cooking or baking provides an entertaining and enjoyable activity for the child user without the risk of injury or other problems associated with toy ovens using a heating element or the like.

Figure 2:
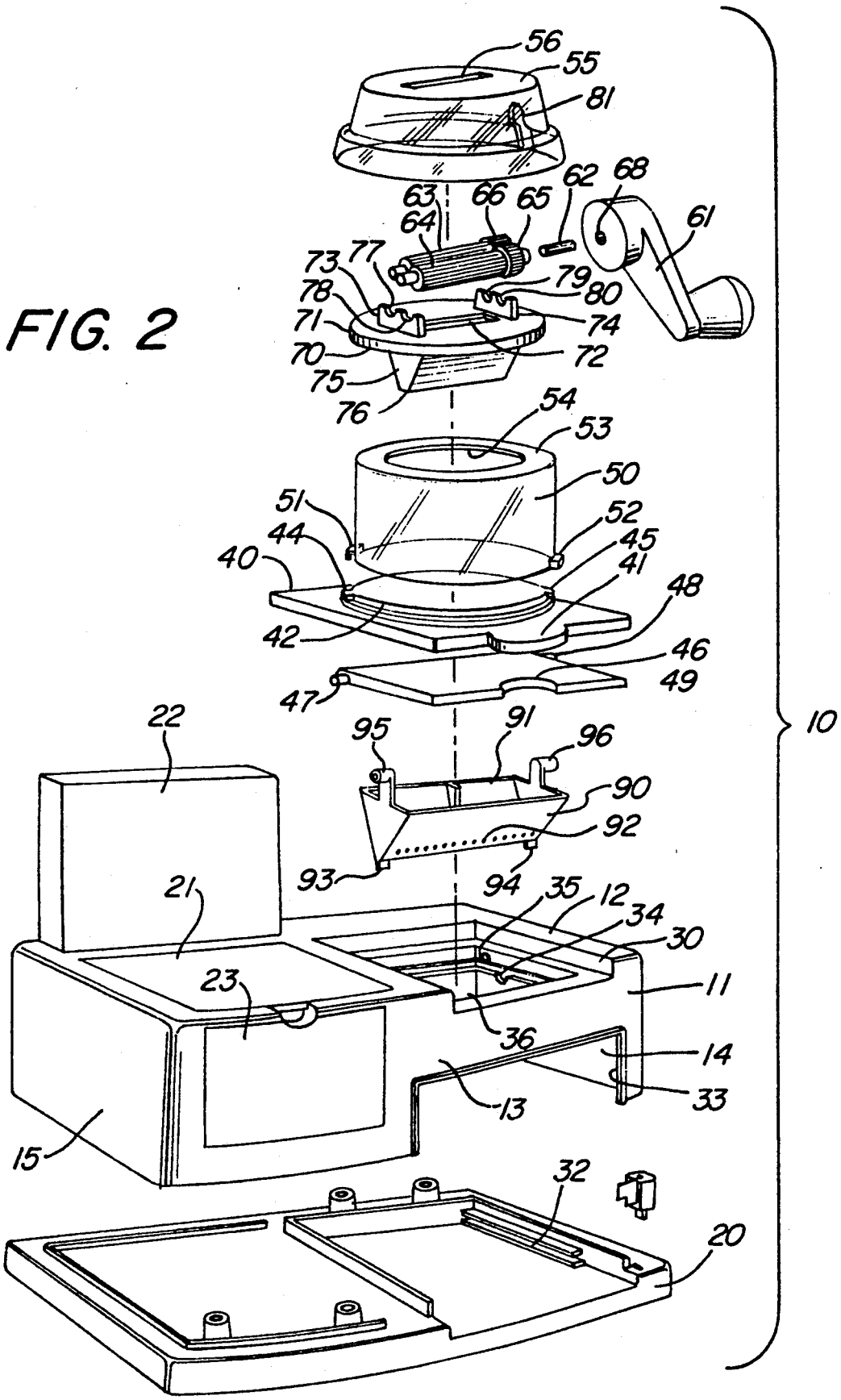
FIG. 2 sets forth a perspective assembly view of the present invention toy food processor and simulated oven.

FIG. 2 sets forth a perspective assembly view of toy food processor and oven 10. Toy oven and food processor 10 includes a generally planar base 20 defining an interior track 32 therein. As mentioned above, base 20 defines a corresponding track oppositely positioned upon base 20 and similar to track 32 such that tray 40 may be slidably received within base 20 in the above-described simulated baking process. A housing 11 defines a generally rectangular enclosure having a top surface 12, a front surface 13 and side surface 14 and 15. Housing 11 further defines a rear surface 16 (better seen in FIG. 6). Top surface 12 defines a recess 30 having an aperture 36 formed therein. A notch 34 and an aperture 35 are formed within housing 11. A door 23 and a top 21 are formed in front surface 13 and top surface 12 respectively. A Vertical backing portion 22 extends upwardly from top surface 12. Front surface 13 further defines a rectangular opening 33.

A powder sprinkler 90 defines a generally trapezoidal member having a reservoir 91 defined therein. Sprinkler 90 further includes a pair of downwardly extending tabs 93 and 94 and defines a plurality of powder sprinkling apertures 92 arranged along the bottom edge of reservoir 91. A pair of generally cylindrical outwardly extending posts 95 and 96 comprise pivotal support members for sprinkler 90.

A generally planar door 49 defines a notch 46 and a pair of outwardly extending hinge posts 47 and 48. A generally rectangular tray 40 defines a forwardly extending handle 41 and a generally cylindrical raised portion 42. A pair of tabs 44 and 45 extend outwardly from raised portion 42.

A cylindrical wall member 50 defines a pair of outwardly extending lock members 51 and 52 and an inwardly extending upper lip 53 forming an aperture 54 at the upper end of cylindrical wall member 50. A grinder housing 70 defines a circular plate 71 supporting a downwardly extending trapezoidally shaped food hopper 75. Hopper 75 terminates in an elongated aperture 76 at the bottom portion thereof. Plate 71 further defines an elongated aperture 72 and an upwardly extending pair of supports 73 and 74 on either end of aperture 72. Support 73 defines a pair of upwardly facing notches 77 and 78 while support 74 defines a corresponding pair of upwardly facing notches 79 and 80.

A pair of generally cylindrical rollers 63 and 64 support a corresponding pairs of gears 66 and 65 respectively. Rollers 63 and 64 are rotatably supported within notches 77 through 80 such that gears 65 and 66 mutually engage. A shaft 62 is operatively coupled between crank handle 61 and roller 64. A cover member 55 defines an elongate slot 56 and a vertical slot 81.

Toy food processor and oven 10 is assembled by initially securing housing 11 to base 20 using conventional fastening means thereby forming baking chamber 31. Sprinkler 90 is received within baking chamber 31 by aligning sprinkler 90 with aperture 36 of housing 11 and moving it downwardly through the center portion of aperture 36 until post 96 is received within notch 34. While not seen in FIG. 2, a corresponding notch identical to notch 34 is positioned on the opposite side of aperture 36 to receive post 95 of sprinkler 90 to complete the pivotal support of sprinkler 90 within baking chamber 31. A quantity of powdered dark material such as chocolate powder, cocoa or cinnamon is deposited within reservoir 91 in the manner set forth below in FIG. 6. Thereafter, door 49 is pivotally secured within housing 11 covering aperture 36 by the insertion of post 48 within aperture 35. Once again, the perspective view of FIG. 2 does not show a corresponding aperture identical to aperture 35 positioned on the opposite side of aperture 36 which receives post 47 in the same manner as post 48 is received within aperture 35 to complete the pivotal attachment of door 49.

Tray 40 is received within recess 30 and rests upon the upper surface of door 49 such that raised portion 42 extends upwardly and handle 41 extends forwardly. Cylindrical wall portion 50 is received upon raised portion 42 such that lock 51 and 52 receive and engage tabs 44 and 45 respectively. Grinder housing 70 is placed upon cylindrical wall portion 50 such food hopper 75 extends downwardly through aperture 54 therein. Rollers 63 and 64 are assembled to support 73 and 74 and shaft 62 is operatively coupled between roller 64 and crank handle 61. Finally, cover 55 is placed upon cylindrical wall portion 50 so as to cover grinder housing 70 and rollers 63 and 64. As described above, rollers 63 and 64 are supported in general alignment with aperture 72 of plate 71 such that gears 65 and 66 are mutually engaged. Thus, as crank handle 61 is rotated, a corresponding rotation of roller 64 is produced due to the coupling of shaft 62 which causes gear 65 to also rotate. The gear coupling between gears 65 and 66 produces an opposite direction rotation of roller 63. Thus, in the preferred form of operation described below in FIG. 3, crank handle 61 is rotated such that roller 64 and roller 63 rotate toward each other in the manner indicated in FIG. 3 below.

Figures 3, 4, 5, 6:
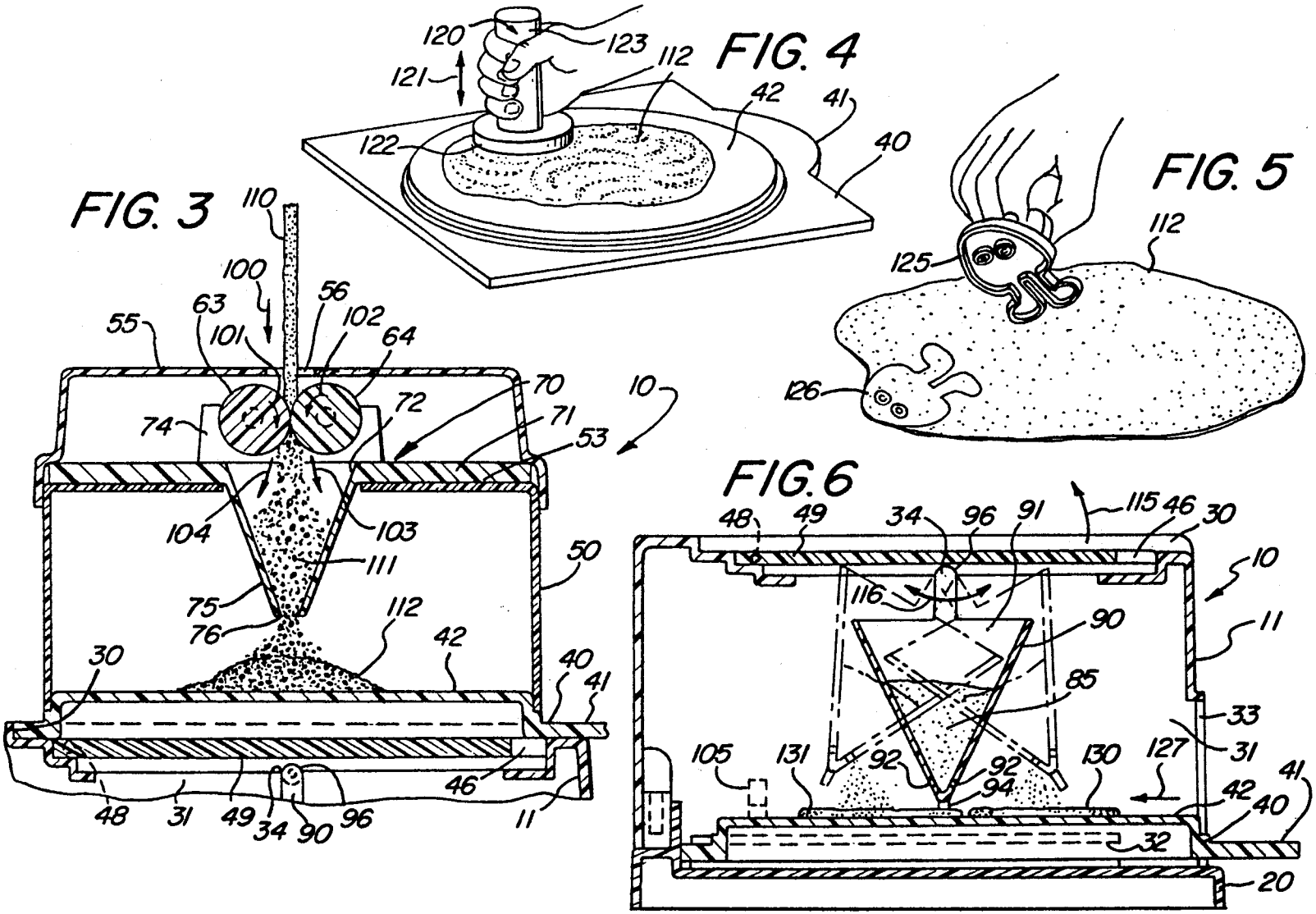
FIG. 3 sets forth a section view of a portion of the present invention toy food processor and simulated oven taken along section lines 3—3 in FIG. 1.
FIG. 4 sets forth a perspective view of the material compacting operation of the present invention toy food processor and simulated oven.
FIG. 5 sets forth a perspective view of a cookie cutting operation performed upon a quantity of food material.
FIG. 6 sets forth a section view of a portion of the present invention toy food processor and simulated oven taken along section lines 6—6 in FIG. 1.

FIG. 3 sets forth a section view of toy food processor and oven 10 taken along section lines 3–3 in FIG. 1. As described above, toy food processor and oven 10 includes a housing 11 defining a recess 30 which receives a generally planar door 49 in a pivotal attachment at a post 48. Housing 11 further defines a notch 34 which receives post 96 of sprinkler 90 to provide a pivotal attachment therebetween better seen in FIG. 6. Door 49 further defines a notch 46 providing for easy manipulation and opening of door 49. A generally planar tray 40 defines a forwardly extending handle 41 and an upwardly extending cylindrical raised portion 42. Tray 40 is slidably received within recess 30 in the manner shown in FIG. 1. A cylindrical wall member 50 is coupled to raised portion 42 of tray 40 in the manner shown in FIG. 1 and defines an inwardly extending upper lip 53 having an aperture 72 defined therein.

A grinder housing 70 includes a plate 71 received upon lip 53 and a downwardly extending trapezoidal food hopper 75 extending through aperture 72 of lip 53. Hopper 75 further defines an elongated aperture 76 at the lower end thereof and a larger elongated aperture 72 at the upper end thereof. As is also described above, grinder housing 70 supports a pair of rotatable rollers 63 and 64 in a manner which includes a vertically extending support 74. Rollers 63 and 64 are generally centered with respect to food hopper 75 in the manner shown in FIG. 3. A cover 55 is received upon plate 71 and cylindrical wall member 50 and defines an elongated slot 56 centered above rollers 63 and 64.

In operation, the user vertically inserts a brittle or easily crumbled food article such as a cracker, a graham cracker or the like downwardly through slot 56 to the intersection of rollers 63 and 64 in the manner shown in FIG. 3. Thus, a cracker 110 is shown vertically inserted through slot 56 to the junction of rollers 63 and 64. Concurrently, the user rotates crank handle 61 (seen in FIG. 1) to produce rotation of rollers 63 and 64 in the directions indicated by arrows 101 and 102. As rollers 63 and 64 continue to rotate and cracker 110 continues to be forced downwardly therebetween, the drawing action imposed upon cracker 110 by the rollers pulls cracker 110 between the rollers crushing the cracker to form a stream of particles 111 which flow downwardly in the manner indicated by arrows 103 and 104 to be collected within food hopper 75. Particles 111 then fall downwardly through aperture 76 of hopper 75 to form a quantity of accumulated food particles 112 upon raised portion 42 of tray 40. This process continues as the user inserts one or more crackers or similar food particles through slot 56 and converts them to crushed particulate matter which is accumulated upon raised portion 42.

Once the desired quantity of accumulated particles 112 has been produced, the user then removes cover 55, cylindrical wall member 50 and food grinder 60 (seen in FIG. 1) either as a single unit or through a succession of sequential disassembly in accordance with the user's preference. Tray 40 is then removed from housing 11 and placed upon a convenient work surface in the manner shown in FIG. 4.

FIG. 4 sets forth a perspective view of tray 40 having an accumulated particle quantity 112 supported thereon. Thus, tray 40 having a handle 41 and a raised portion 42 supporting a quantity of accumulated granular particles 112 is rested upon a convenient surface. Thereafter, a tamper 120 having a handle 123 and a flat lower portion 122 is utilized by the child user to evenly spread particles 112 upon raised portion 42 of tray 40 and utilizing vertical strokes in the directions indicated by arrow 121 further compact accumulated particles 112. It should be noted that the user may prefer to combine other materials such as a suitable binding agent or convenient kitchen liquid such as milk or the like in small quantity to further process accumulated particles 112.

FIG. 5 sets forth the use of a cookie cutter 125 to form a suitably shaped cookie 126 in accordance with conventional cookie cutter operation. Once the desired cookie shapes have been provided, excess material may be removed leaving a plurality of suitably formed cookies such as cookies 130 and 131 shown in FIG. 6 upon raised portion 42 of tray 40.

With specific reference to FIG. 6 which sets forth a section view of toy food processor and oven 10 taken along section lines 6—6 in FIG. 1, the operation of the present invention simulated browning within baking chamber 31 is shown. Thus, as described above, toy food processor and oven 10 includes a housing 11 supported upon a base 20 and defining a rectangular frontal opening 33 and an interior baking chamber 31. Housing 11 further defines a recess 30 supporting a door 49 in a pivotal attachment at a post 48. Door 49 further defines a notch 46 in the frontal portion thereof. Housing 11 further defines a notch 34 at the center portion thereof.

A sprinkler 90 includes a pair of outwardly extending support posts 95 and 96 (seen in FIG. 2) which pivotally support sprinkler 90 in a freely movable manner within baking chamber 31. With specific reference to FIG. 6, post 96 is received within notch 34. Sprinkler 90 defines a triangularly-shaped housing having an interior reservoir 91 receiving a quantity of powdered coloring material such as cocoa, powdered chocolate, cinnamon or the like. Sprinkler 90 further defines a pair of downwardly extending tabs 94 and 93 (the latter seen in FIG. 2). A plurality of apertures 92 are formed along the lower end of sprinkler 90 and extend into reservoir 91.

In further accordance with the present invention, tray 40 having a handle 41 and a raised portion 42 supports a plurality of formed cookies such as cookies 130 and 131 produced in the manner described above. Tray 40 is slidably received within baking chamber 31 through frontal opening 33 utilizing track 32 to provide support and guidance for tray 40 such that tray 40 is received in the position shown in FIG. 6.

Once tray 40 supporting cookies 130 and 131 is positioned within baking chamber 31, the user may open door 49 utilizing notch 46 and pivoting door 49 upwardly in the direction indicated by arrow 115. Thereafter, the user may simply reach in and disturb or angularly displace sprinkler 90 from its normal vertical position shown in solid line representation to either of the angularly displaced positions shown in dashed-line representation. Thereafter, the release of sprinkler 90 causes sprinkler 90 to freely swing between the dashed-line positions shown in the directions indicated by arrow 116. As sprinkler 90 swings back and forth above cookies 130 and 131, a quantity of powdered material 85 is caused to flow outwardly through apertures 92 and fall upon cookies 130 and 131. The accumulation of powdered material upon cookies 130 and 131 produces the above-described simulated browning effect given cookies 130 and 131 an oven browned or baked appearance. Thereafter, tray 40 is withdrawn from baking chamber 31.

As a alternative, various other mechanisms may be utilized to produce the sprinkling action of sprinkler 90 without resorting to opening door 49. For example, a sliding tab 105 shown in dashed-line representation may be slidably supported within track 32 and displaced in the direction of arrow 127 as tray 40 is received within baking chamber 31. Tab 105 then contacts tab 94 of sprinkler 90 displacing sprinkler 90 angularly and then leaving sprinkler 90 to freely pivot back and forth in the direction indicated by arrow 116 to produce the simulated browning effect by depositing articles 85 upon cookies 130 and 131 in the manner shown. By way of further alternative, tab 105 may extend upwardly from tray 40 or be separately secured to tray 40 during the simulated baking process to provide the same desired movement of sprinkler 90. By way of further alternative, various other articulated mechanisms constructed in accordance with conventional fabrication techniques may be operative within housing 11 to utilize the insertion motion of tray 40 to impart a swinging or pivotal motion to sprinkler 90 without departing from the spirit and scope of the present invention. The important aspect of the present invention is provided by the distribution of darkened powdered or finely ground material such as cinnamon, cocoa powdered chocolate or the like upon cookies 130 and 131 while tray 40 is within baking chamber 31.

What has been shown is a novel toy food processor and oven which permits the child to prepare a cookie "dough" comprising a quantity of crushed particles using several cookies or graham crackers or the like. The toy food processor and oven then utilizes a simulated baking process in which the child user having formed a plurality of cookies upon a cookie tray then obtains the appearance of baked cookies or oven brown cookies through inserting the cookie bearing tray into a simulated oven. The oven is entirely free of a heating element and poses no safety risk to the child whatsoever. The appearance of baked food articles is derived by distributing finely ground or powdered material such as cocoa, cinnamon, powdered chocolate or the like upon the cookies during the simulated baking process.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy oven for use in combination with a crushable food article and a colored powdered food article, said toy oven comprising:

a housing defining a simulated baking chamber;

crushing means for crushing said food article to form a crushed particulate food material suitable for forming into one or more shaped food objects; and simulated baking means supported proximate said simulated baking chamber and having means for receiving said colored powdered food article and for imparting a baked appearance to said food objects within said simulated baking chamber by depositing a quantity of said colored powdered material thereupon.

2. A toy oven as set forth in claim 1 wherein said simulated baking means includes a sprinkler having a reservoir for receiving a quantity of said colored powdered material and defining a plurality of sprinkling apertures.

3. A toy oven as set forth in claim 2 wherein said sprinkler includes an elongated container pivotally supported within said simulated baking chamber and defining a lower end having said sprinkling apertures formed therein.

4. A toy oven as set forth in claim 3 wherein said crushing means includes a pair of elongated generally cylindrical rollers and hand crank means for rotating said rollers mutually inwardly.

5. A toy oven as set forth in claim 4 wherein said crushing means includes a tray having an upper surface and a wall member supported upon said tray and having means for supporting said rollers above said upper surface.

6. A toy oven as set forth in claim 5 wherein said upper surface includes a raised generally cylindrical surface and wherein said wall member is generally cylindrical.

7. A toy oven as set forth in claim 6 wherein said crushing means includes a cover received upon said wall member and defining a surface covering said rollers, said surface defining an elongated slot generally aligned with and centered above said rollers.

8. A toy oven as set forth in claim 1 wherein said crushing means includes a pair of elongated generally cylindrical rollers and hand crank means for rotating said rollers mutually inwardly.

9. A toy oven as set forth in claim 8 wherein said crushing means includes a tray having an upper surface and a wall member supported upon said tray and having means for supporting said rollers above said upper surface.

10. A toy oven as set forth in claim 9 wherein said upper surface includes a raised generally cylindrical surface and wherein said wall member is generally cylindrical.

11. A toy oven as set forth in claim 10 wherein said crushing means includes a cover received upon said wall member and defining a surface covering said rollers, said surface defining an elongated slot generally aligned with and centered above said rollers.

12. A toy oven as set forth in claim 11 wherein said simulated baking means includes a sprinkler having a reservoir for receiving a quantity of said colored powdered material and defining a plurality of sprinkling apertures.

13. A toy oven as set forth in claim 12 wherein said sprinkler includes an elongated container pivotally supported within said baking chamber and defining a lower end having said sprinkling apertures formed therein.

14. A toy oven for use in combination with a crushable food article and a dark food colorant, said toy oven comprising:

a housing defining an upper surface, an interior baking chamber and an opening for access to said baking chamber;

a food crusher supported upon said upper surface and including a generally planar tray, a crusher assembly and support means for supporting said crusher assembly above said tray; and simulated baking means supported within said baking chamber operative to impart a baked appearance to food material within said baking chamber by depositing said food colorant thereupon.

15. A toy oven as set forth in claim 14 wherein said food article is crushed by said food crusher to form a collection of particles upon said tray to provide a to-be-baked item and wherein said tray defines a width less than the width of said opening to permit said tray bearing said to-be-baked item is inserted into said baking chamber through said opening.

16. A toy oven as set forth in claim 15 wherein said food colorant is powdered and wherein said simulated baking means includes means for sprinkling said powdered food colorant upon said to-be-baked item within said baking chamber.

17. A toy oven as set forth in claim 16 wherein said simulated baking means includes means operative in response to insertion of said tray into said baking chamber to produce said sprinkling.

* * * * *